US007210423B2

(12) United States Patent
Haugen

(10) Patent No.: US 7,210,423 B2
(45) Date of Patent: May 1, 2007

(54) THRU-HULL CAP

(76) Inventor: Paul A. Haugen, 9477 E. Sunnyside, Scottsdale, AZ (US) 85260

( * ) Notice: Subject to any disclaimer, the term of this patent is extended or adjusted under 35 U.S.C. 154(b) by 0 days.

(21) Appl. No.: 11/286,027

(22) Filed: Nov. 23, 2005

(65) Prior Publication Data

US 2006/0118024 A1 Jun. 8, 2006

Related U.S. Application Data

(60) Provisional application No. 60/630,328, filed on Nov. 23, 2004.

(51) Int. Cl.
*B63B 13/00* (2006.01)

(52) U.S. Cl. ..... 114/183 R

(58) Field of Classification Search ..... 114/182, 114/183 R, 197, 198, 343; 137/312, 360, 137/377, 381
See application file for complete search history.

(56) References Cited

U.S. PATENT DOCUMENTS

| | | | | |
|---|---|---|---|---|
| 3,475,772 | A * | 11/1969 | Lokken | 114/183 R |
| 4,874,324 | A | 10/1989 | Andersen et al. | |
| 4,935,129 | A | 6/1990 | Wang | |
| 5,722,339 | A | 3/1998 | Gross | |
| 6,038,992 | A * | 3/2000 | Smith | 114/183 R |
| 6,162,082 | A | 12/2000 | Karsten et al. | |
| 6,164,231 | A | 12/2000 | Shimmell et al. | |
| 6,241,440 | B1 | 6/2001 | Orlebeke | |
| 6,578,876 | B2 | 6/2003 | Guertin, Jr. | |

* cited by examiner

*Primary Examiner*—Lars A. Olson
(74) *Attorney, Agent, or Firm*—Craig Weiss; Weiss & Moy, P.C.

(57) ABSTRACT

A thru-hull cap cover for a watercraft thru-hull and method therefor capable of covering and protecting the exposed exterior end of a thru-hull from the elements, thus reducing the need to replace a watercraft thru-hull.

14 Claims, 1 Drawing Sheet

THRU-HULL CAP

CROSS-REFERENCE TO RELATED APPLICATION

This application claims priority to a corresponding provisional application U.S. Ser. No. 60/630,328, filed Nov. 23, 2004 in the name of the applicant of this application.

FIELD OF THE INVENTION

This invention relates generally to watercraft accessories and, more specifically, to a thru-hull cap dimensioned to cover the open end of a thru-hull and method therefor.

BACKGROUND OF THE INVENTION

Boating, sailing, jet skiing and other water sports are very popular forms of recreation. Virtually all watercraft are constructed with at least one thru-hull, a device inserted through the hull of a watercraft and designed to drain or expel excess water out of the watercraft. Usually, thru-hulls are installed at a manufacturing stage of the watercraft, however it is often the case that thru-hulls are installed at a post-manufacturing stage either to replace a broken thru-hull, repair a leak, or to simply add a new drainage area to the watercraft. The interior end of the thru-hull is typically coupled to a hose that is connected to a bilge pump for pumping excess water out of the watercraft. The exterior end of the thru-hull, which is coupled to the exterior surface of the hull, is exposed to the elements.

Often, a need arises to replace a thru-hull due to the deterioration of this exposed exterior end of the thru-hull. While the rest of the thru-hull is shielded from the elements inside the watercraft and is otherwise in perfect working order, the exposed exterior end of the thru-hull is subject to cracking and other deterioration as a result of direct exposure to sunshine, wind, rain, water, salt water and physical contact with the dock. Depending upon their placement on the watercraft, obtaining access to existing thru-hulls in order to replace them can often be a difficult and time-consuming process.

A need therefore existed for a thru-hull cap capable of covering the exposed open end of a thru-hull in order to help prevent deterioration and destruction of the thru-hull, thus negating the need for thru-hull replacement.

SUMMARY OF THE INVENTION

An object of the present invention is to provide a thru-hull cap for a thru-hull and method therefor capable of covering and protecting the exposed exterior end of a thru-hull.

BRIEF DESCRIPTION OF THE PREFERRED EMBODIMENTS

In accordance with one embodiment of the present invention, a thru-hull cap for a watercraft thru-hull is disclosed, comprising, in combination, a thru-hull having a first open end and a second open end and a tube therebetween, the thru-hull dimensioned to be inserted through a hull of a watercraft so that the first open end being coupled proximate an interior surface of the hull and the second open end being coupled proximate an exterior surface of the hull, the thru-hull dimensioned to expel excess liquid through the tube and the second end of the thru-hull and out of the watercraft, and a covering defining an opening and having an interior surface and an exterior surface, the interior surface of the covering dimensioned to mate with an exterior surface of the second open end of the thru-hull, the covering dimensioned to cover substantially all of the exterior surface of the second open end of the thru-hull while at the same time allowing for excess liquid to be expelled through the opening defined by the covering.

In accordance with yet another embodiment of the present invention, a thru-hull cap for a watercraft thru-hull is disclosed comprising, in combination, a thru-hull having a first open end and a second open end and a tube therebetween, the thru-hull dimensioned to be inserted through a hull of a watercraft so that the first open end being coupled proximate an interior surface of the hull and the second open end being coupled proximate an exterior surface of the hull, the thru-hull dimensioned to expel excess liquid through the tube and the second end of the thru-hull and out of the watercraft, a covering defining an opening and having an interior surface and an exterior surface, the interior surface of the covering dimensioned to mate with the second open end of the thru-hull, the covering dimensioned to cover substantially all of an exposed portion of the second open end of the thru-hull while at the same time allowing for excess liquid to be expelled through the opening defined by the covering, an adhesive coupled to an interior surface of the covering and dimensioned to couple the covering to the second open end of the thru-hull, and a substantially circular flange coupled to the covering proximate the interior surface of the covering, the circular flange dimensioned to be inserted through the second open end of the thru-hull and into the tube until the interior surface of the covering being in direct contact with the exterior surface of the second open end of the thru-hull.

In accordance with still another embodiment of the present invention, a method for protecting a thru-hull is disclosed comprising, in combination, the steps of providing a thru-hull having a first open end and a second open end and a tube therebetween, inserting the thru-hull through a hull of a watercraft so that the first open end being coupled proximate an interior surface of the hull and the second open end being coupled proximate an exterior surface of the hull, the thru-hull dimensioned to expel excess liquid through the tube and the second end of the thru-hull and out of the watercraft, providing a covering defining an opening and having an interior surface and an exterior surface, and mating the interior surface of the covering with an exterior surface of the second open end of the thru-hull so that the covering covers substantially all of the exterior surface of the second open end of the thru-hull while at the same time allowing for excess liquid to be expelled through the opening defined by the covering.

The foregoing and other objects, features, and advantages of the invention will be apparent from the following, more particular description of the preferred embodiments of the invention, as illustrated in the accompanying drawings.

DETAILED DESCRIPTION OF THE PREFERRED EMBODIMENTS

Figure 1:
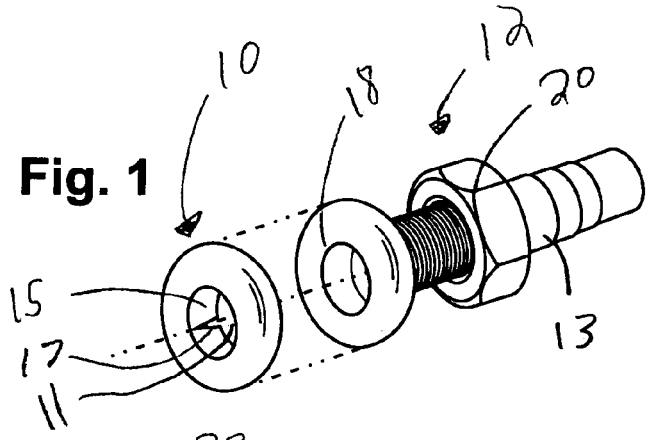
FIG. 1 is a perspective view of one embodiment of the thru-hull cap of the present invention.
Figure 2:
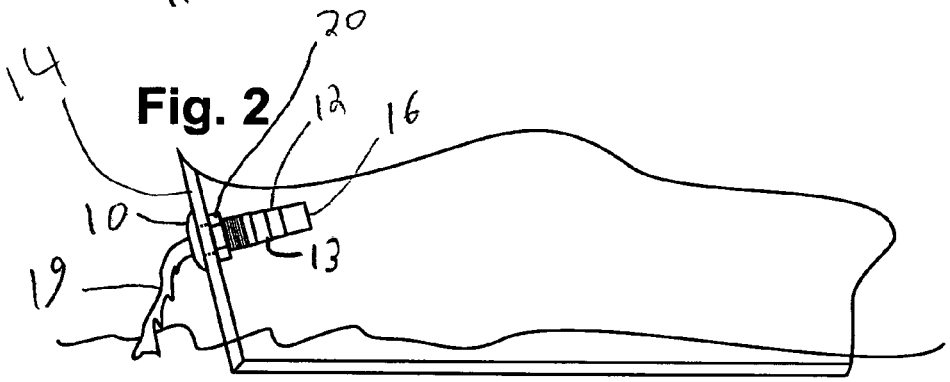
FIG. 2 is a side, cross-sectional view of a thru-hull coupled to a boat and having a thru-hull cap.

Referring to FIGS. 1–3*d*, a thru-hull cap, hereinafter thru-hull cap 10, of the present invention is shown. A thru-hull 12 is typically used in order to drain excess water 19 (shown in FIG. 2) out of a watercraft 14. The watercraft 14 may be a boat (shown in FIG. 2), a jet ski or some other type of watercraft that requires draining. Typically, the larger the watercraft, the greater the number of thru-hulls 12 used to drain water 19 out of the watercraft 14. A standard thru-hull 12 comprises a tube 13 having a first open end 16 dimensioned to be coupled to a hose (not shown) that is usually connected to a bilge pump (not shown), sink (not shown), circulation pump (not shown), or any other apparatus used to discharge water overboard. Thru-hulls 12 can also be used to drain excess water 19 from a watercraft 14 by gravity, under pressure or by some other means. The thru-hull 12 comprises a second open end 18 for expelling the excess water 19 out of the watercraft 14. Usually a thru-hull 12 is substantially tube-shaped with a threaded portion proximate the second open end 18 and a nut 20 for securing the thru-hull 12 to the watercraft 14.

Figure 3A:
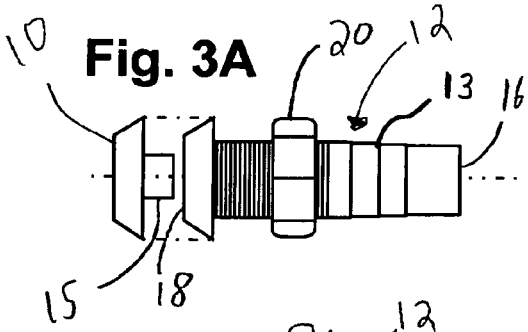
FIG. 3*a* is a side view of another embodiment of the thru-hull cap of the present invention, showing a substantially trapezoidal-shaped thru-hull cap.
Figure 3B:
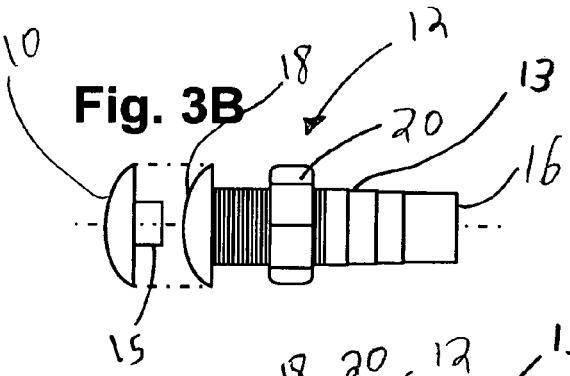
FIG. 3*b* is a side view of another embodiment of the thru-hull cap of the present invention, showing a substantially round-shaped thru-hull cap.
Figure 3C:
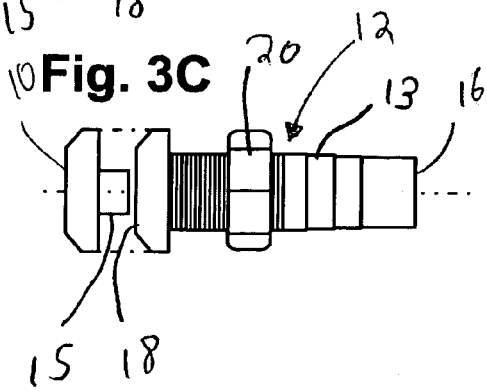
FIG. 3*c* is a side view of another embodiment of the thru-hull cap of the present invention, showing a substantially hexagonal-shaped thru-hull cap.
Figure 3D:
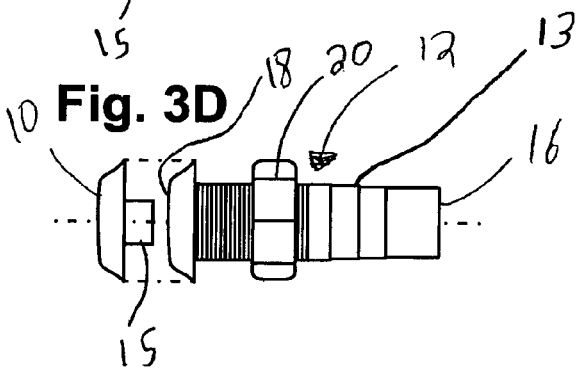
FIG. 3*d* is a side view of another embodiment of the thru-hull cap of the present invention, showing a substantially trapezoidal-shaped thru-hull cap having slightly curved side portions.

The second end 18 of the thru-hull 12 is typically either trapezoidal-shaped (as shown in FIG. 3A), round-shaped (as shown in FIG. 3B), hexagonal-shaped (as shown in FIG. 3C) or substantially trapezoidal-shaped having slightly curved side portions (as shown in FIG. 3*d*).

Still referring to FIGS. 1–3D a thru-hull cap, hereinafter thru-hull cap 10, is shown. The thru-hull cap 10 comprises a covering dimensioned to be coupled to the second open end 18 of the thru-hull 12 in order to prevent wear and tear or other damage to a standard thru-hull 12. The thru-hull cap 10 defines an opening 11 (shown in FIG. 1) dimensioned to correspond to the opening defined by the second open end 18 of the thru-hull 12. In this way, a thru-hull cap 10 could be substantially trapezoidal-shaped (as shown in FIG. 3A), round-shaped (as shown in FIG. 3B), hexagonal-shaped (as shown in FIG. 3C), substantially trapezoidal-shaped having slightly curved side portions (as shown in FIG. 3*d*) or any other shape necessary to mate securely with the second end 18 of a corresponding thru-hull 12 of the same shape.

In addition, a thru-hull cap 10 could be used to maintain a color scheme or a theme, such as stainless steel, that is already present in the boat's decor. In one embodiment, a UV resistant plastic thru-hull cap 10 could be made in various colors to match pin-striping on boats. The thru-hull cap 10 could be comprised of plastic, stainless steel, brass, bronze, a marine enamel such as power coat, or some other material. While, in the preferred embodiment, the thru-hull cap 10 is comprised of a material designed to protect the second open end 18 of the thru-hull 12 from deterioration, such as stainless steel, it should be clearly understood that substantial benefit could be derived from an alternative embodiment of the present invention in which the main purpose of the thru-hull cap 10 is to provide a matching decor for a watercraft 14.

In the preferred embodiment, the thru-hull cap 10 further comprises an adhesive in order to securely couple the thru-hull cap 10 to an exterior surface the open second end 18 of the thru-hull 12. The adhesive can be silicon, acrylic based, acid based, a cured rubber or some other kind of material capable of securely coupling the thru-hull cap 10 to the open second end 18 of the thru-hull 12. The adhesive may be coupled to a bottom surface of the thru-hull cap 10, or alternatively to an exterior surface of the open second end 18 of the thru-hull 12.

In the preferred embodiment, the thru-hull cap 10 further comprises a substantially circular flange 15 coupled to a bottom surface of the thru-hull cap 10 proximate the opening 11 and extending from the interior surface of the thru-hull cap 10. Preferably, the circular flange 15 has a thickness of approximately five millimeters, although it should be clear that substantial benefit could be derived from an alternative embodiment of the circular flange 15 that deviates, even substantially, from the preferred thickness, in either direction. The substantially circular flange 15 is dimensioned to be inserted into the tube 13 through the open second end 18 of the thru-hull 12 in order to more securely couple the thru-hull cap 10 to the thru-hull 12. Further preferably, the substantially circular flange 15 defines a notch 17 (shown in FIG. 1) dimensioned to allow a user to squeeze the substantially circular flange 15 in order to adjust the outer diameter of the substantially circular flange 15 for mating the flange 15 with the second open end 18 of a thru-hull 12. It should be clearly understood that while an adhesive is preferably coupled to a bottom surface of the thru-hull cap for purposes of coupling the thru-hull cap 10 to an open second end 18 of a thru-hull 12, it is within the spirit and scope of this invention that an adhesive be coupled to at least a portion of the circular flange 15 either in place of or in addition to the adhesive used on the bottom surface of the thru-hull cap 10. It is also within the spirit and scope of the invention that no adhesive be used, so long as the thru-hull cap 10 can be secured to the second open end 18 of the thru-hull 12, for example, by frictional engagement of an exterior surface of the circular flange 15 with an interior surface of the tube 13.

While, in the preferred embodiment, the thru-hull cap 10 comprises a substantially circular flange 15 defining a notch 17, it should be clearly understood that substantial benefit could be derived from an alternative embodiment of the present invention in which the thru-hull cap 10 does not comprise a substantially circular flange 15 or in which the flange 15 does not define a notch 17.

Statement of Operation

In order to install the thru-hull cap 10 of the present invention, one preferably applies an adhesive to a bottom surface of the thru-hull cap 10, or alternatively, one peels back a protective covering exposing an adhesive on the bottom surface of the thru-hall cap 10. In one embodiment, an adhesive can be applied to the substantially circular flange 15. In another embodiment, an adhesive is applied to the open second end 18 of the thru-hull 12. Once an adhesive is either applied or exposed, the thru-hull cap 10 is securely coupled to the second open end 18 of the thru-hull 12. In one embodiment, the substantially circular flange 15 may need to be squeezed in order to facilitate insertion of the substantially circular flange 15 into the tube 13 through the second open end 18 of the thru-hull 12.

While the invention has been particularly shown and described with reference to preferred embodiments thereof, it will be understood by those skilled in the art that the foregoing and other changes in form and details may be made therein without departing from the spirit and scope of the invention.

I claim:

1. A thru-hull cap for a watercraft thru-hull comprising, in combination:

a thru-hull having a first open end and a second open end and a tube therebetween, said thru-hull dimensioned to be inserted through a hull of a watercraft so that said first open end being coupled proximate an interior surface of said hull and said second open end being coupled proximate an exterior surface of said hull, said thru-hull dimensioned to expel excess liquid through said tube and said second end of said thru-hull and out of said watercraft; and a covering defining an opening and having an interior surface and an exterior surface, said interior surface of said covering dimensioned to mate with an exterior surface of said second open end of said thru-hull, said covering dimensioned to cover substantially all of said exterior surface of said second open end of said thru-hull while at the same time allowing for excess liquid to be expelled through said opening defined by said covering.

2. The thru-hull cap of claim 1 further comprising an adhesive coupled to an interior surface of said covering and dimensioned to couple said covering to said second open end of said thru-hull.

3. The thru-hull cap of claim 1 further comprising a substantially circular flange coupled to said covering proximate said interior surface of said covering, said circular flange dimensioned to be inserted through said second open end of said thru-hull and into said tube until said interior surface of said covering being in direct contact with said exterior surface of said second open end of said thru-hull.

4. The thru-hull cap of claim 3 wherein said substantially circular flange defines a notch dimensioned to allow a user to squeeze said substantially circular flange in order to decrease an outer diameter of said substantially circular flange for inserting said substantially circular flange into said tube in order to couple said covering to said exterior surface of said second open end of said thru-hull.

5. The thru-hull cap of claim 3 wherein said covering and said circular flange form a one-piece assembly.

6. The thru-hull cap of claim 1 wherein said covering being comprised of a UV-resistant plastic.

7. The thru-hull cap of claim 1 further comprising a nut having a threaded interior portion and dimensioned to mate with a corresponding threaded exterior portion of said tube, said nut dimensioned to frictionally engage said interior surface of said hull of said watercraft in order to secure said thru-hull to said hull of said watercraft.

8. A thru-hull cap for a watercraft thru-hull comprising, in combination:

a thru-hull having a first open end and a second open end and a tube therebetween, said thru-hull dimensioned to be inserted through a hull of a watercraft so that said first open end being coupled proximate an interior surface of said hull and said second open end being coupled proximate an exterior surface of said hull, said thru-hull dimensioned to expel excess liquid through said tube and said second end of said thru-hull and out of said watercraft;

a covering defining an opening and having an interior surface and an exterior surface, said interior surface of said covering dimensioned to mate with said second open end of said thru-hull, said covering dimensioned to cover substantially all of an exposed portion of said second open end of said thru-hull while at the same time allowing for excess liquid to be expelled through said opening defined by said covering;

an adhesive coupled to an interior surface of said covering and dimensioned to couple said covering to said second open end of said thru-hull; and a substantially circular flange coupled to said covering proximate said interior surface of said covering, said circular flange dimensioned to be inserted through said second open end of said thru-hull and into said tube until said interior surface of said covering being in direct contact with said exterior surface of said second open end of said thru-hull.

9. The thru-hull cap of claim 8 wherein said substantially circular flange defines a notch dimensioned to allow a user to squeeze said substantially circular flange in order to decrease an outer diameter of said substantially circular flange for inserting said substantially circular flange into said tube in order to couple said covering to said exterior surface of said second open end of said thru-hull.

10. A method for protecting a thru-hull comprising, in combination, the steps of:

providing a thru-hull having a first open end and a second open end and a tube therebetween;

inserting said thru-hull through a hull of a watercraft so that said first open end being coupled proximate an interior surface of said hull and said second open end being coupled proximate an exterior surface of said hull, said thru-hull dimensioned to expel excess liquid through said tube and said second end of said thru-hull and out of said watercraft;

providing a covering defining an opening and having an interior surface and an exterior surface; and mating said interior surface of said covering with an exterior surface of said second open end of said thru-hull so that said covering covers substantially all of said exterior surface of said second open end of said thru-hull while at the same time allowing for excess liquid to be expelled through said opening defined by said covering.

11. The method of claim 10 further comprising the steps of:

providing an adhesive coupled to an interior surface of said covering; and coupling said interior surface of said covering to said exterior surface of said second open end of said thru-hull with said adhesive.

12. The method of claim 10 further comprising the steps of:

providing a substantially circular flange coupled to said covering proximate said interior surface of said covering; and inserting said substantially circular flange through said second open end of said thru-hull and into said tube until said interior surface of said covering being in direct contact with said exterior surface of said second open end of said thru-hull.

13. The method of claim 12 wherein said substantially circular flange defines a notch and further comprising the steps of:

squeezing said substantially circular flange in order to decrease an outer diameter of said substantially circular flange;

inserting said substantially circular flange into said second open end of said thru-hull and into said tube; and releasing said substantially circular flange in order to increase an outer diameter of said substantially circular flange so that said substantially circular flange frictionally engages an interior surface of said tube and said interior surface of said covering being in direct contact with said exterior surface of said second open end of said thru-hull.

14. The method of claim 10 further comprising the steps of:

providing a nut having a threaded interior portion; and mating said nut with a corresponding threaded exterior portion of said tube until said nut frictionally engages said interior surface of said hull of said watercraft in order to secure said thru-hull to said hull of said watercraft.

* * * * *